US007748701B2

(12) United States Patent
Gustafsson et al.

(10) Patent No.: US 7,748,701 B2
(45) Date of Patent: Jul. 6, 2010

(54) METHOD AND ARRANGEMENT FOR FEEDING OUT END SHEETS FROM A STACK OF SHEETS

(75) Inventors: Lars Gustafsson, Katrineholm (SE); Jörgen Sundmark, Katrineholm (SE)

(73) Assignee: De La Rue Cash Systems AB, Flen (SE)

( * ) Notice: Subject to any disclaimer, the term of this patent is extended or adjusted under 35 U.S.C. 154(b) by 0 days.

(21) Appl. No.: 12/095,499

(22) PCT Filed: Nov. 30, 2006

(86) PCT No.: PCT/SE2006/001370

§ 371 (c)(1),
(2), (4) Date: May 29, 2008

(87) PCT Pub. No.: WO2007/064282

PCT Pub. Date: Jun. 7, 2007

(65) Prior Publication Data

US 2008/0272535 A1 Nov. 6, 2008

(30) Foreign Application Priority Data

Dec. 1, 2005 (SE) ..... 0502628

(51) Int. Cl.
*B65H 3/06* (2006.01)

(52) U.S. Cl. ..... 271/152; 271/153

(58) Field of Classification Search ..... 271/149, 271/152, 153

See application file for complete search history.

(56) References Cited

U.S. PATENT DOCUMENTS 4,368,881 A 1/1983 Landa et al.
4,883,264 A * 11/1989 Yoshikawa et al. ..... 271/110
4,919,412 A * 4/1990 Weigel et al. ..... 271/110
4,940,224 A 7/1990 Couper et al.
5,195,735 A 3/1993 Sellers
6,032,946 A * 3/2000 Marshall et al. ..... 271/152
6,896,255 B1 * 5/2005 Fick et al. ..... 271/126
2002/0130459 A1 9/2002 Herrmann

FOREIGN PATENT DOCUMENTS

EP 0 174 200 3/1986
JP 02225238 A * 9/1990
JP 03243537 A * 10/1991
JP 04354736 A * 12/1992
SE 522 324 2/2004

* cited by examiner

*Primary Examiner*—David H Bollinger
(74) *Attorney, Agent, or Firm*—Dickstein Shapiro LLP

(57) ABSTRACT

A method and an arrangement for feeding out end sheets from a stack of sheets comprises that a driver acting against the end sheet of the stack (1) first displaces the end sheet in the plane thereof toward a support for elastic bulging of the end sheet, and then displaces the buckled end sheet away from the support, to a separating arrangement for the separation of sheets that unintentionally are accompanying the end sheet (21) fed out. The driver being carried by a spring arrangement, which offers an increasing support force to the driver upon the advancement of the stack by means of a pusher acting against the rear end of the stack. A sensor detects the displacement position of the driver, and activates the driver for a sheet-outfeed operation when the distance sensor detects a displacement position of the driver corresponding to a predetermined abutment force of the driver against the end sheet. Between the sheet-outfeed operations, the pusher is unloaded.

14 Claims, 2 Drawing Sheets

METHOD AND ARRANGEMENT FOR FEEDING OUT END SHEETS FROM A STACK OF SHEETS

Figure 1:
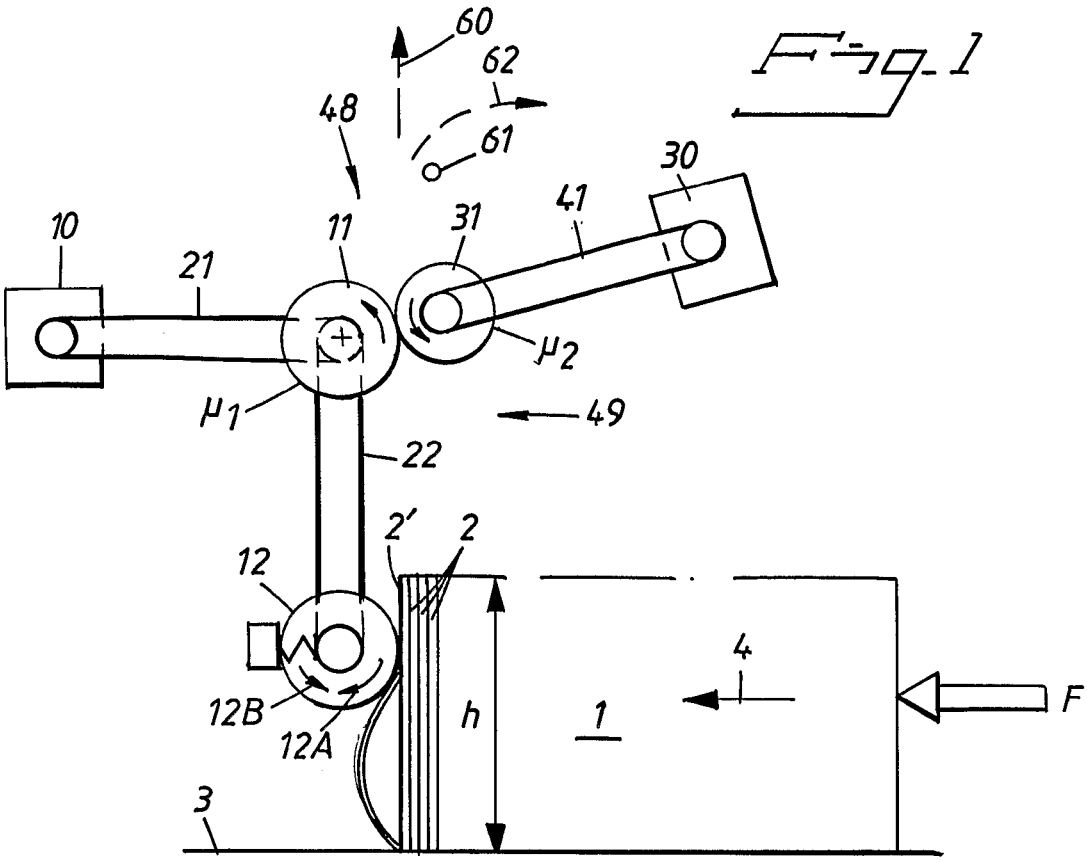

The invention relates to a method and an arrangement of the kind that is seen in the preamble of the appended independent claim and the arrangement claim (U.S. Pat. No. 5,195,735), respectively.

In arrangements for feeding out sheet-like documents from a stack or regular sheaf of sheets, for instance documents, in particular documents of value such as, for instance, banknotes, it is well known to press a driver having a given friction coefficient against an end sheet of the stack, and to displace the driver in such a way that the end sheet is moved in the plane thereof away from the stack. It is well known that the driver occasionally not only conveys the end sheet but also one or more adjacent sheets from the stack, and in that connection, it is also well known to let the driver transport the sheet/the group of sheets to a separator, in which the unintentionally conveyed sheets are separated from the end sheet and taken care of, while the end sheet is further transported for another further handling. The outfeed function is repeated all the way until a predetermined number of individual sheets have been detected to leave the separator, of an ordered delivery of sheets.

However, a problem is that the mutual friction between adjacent sheets of the sheaf may vary considerably in different sheaves. Furthermore, the mutual friction between adjacent sheets in the sheaf of sheets may be relatively high, so that an outfeed operation of the kind indicated relatively often entails that a group of additional sheets accompanies the end sheet in the outfeed operation. Even if the separator is capable of separating the unintentionally conveyed sheets, it is a drawback that the sheets separated by the separator are not directly at disposal for feeding to the intended final destination.

If the mutual friction between the sheets in the stack of sheets is annoyingly high, it may furthermore happen that the number of sheets lifted out of the stack by the driver in an outfeed operation is so great that the separator incapable of separating the additional conveyed sheets. Then further other problems arise, which means that the entire group of sheets has to be diverted, which means that the outfeed operation of the driver does not cause that any sheet can be further transported through the separator and be included in the requested delivery of a certain number of sheets to an end user. Naturally, this means a time delay of the overall delivery operation.

If, for instance, the sheets consist of banknotes that come directly from a banknote printing works or the like in the form of a stack or sheaf, the mutual adhesion of the sheets may be relatively large. Especially when the sheets/banknotes are formed of certain plastic materials, such as polypropylene, high mutual friction in the stack has been noted. However, the problem is not limited to such situations, but also occurs when the friction between the sheets in the stack varies, since the outfeed device should be adjusted so as to present a reliable outfeed of preferably individual sheets, and the separator has to be able to solve the task thereof and should preferably also be able to remove a group of sheets that cannot pass through the separator and that cannot be separated by the separator.

When the side of the stack, i.e., the edges of the sheets in the stack, is carried on a substantially horizontal support and is displaced along the same by a pusher/force transducer so that the foremost sheet of the stack can be pressed against the driver, certain well known advantages are attained, but the advancing resistance of the stack of sheets varies, for instance because of the difference between the sliding friction and static friction, the number of sheets in the stack, variation of the friction of the sheets against the support.

Therefore, an object of the invention is to present a technique, by means of which the mentioned drawbacks can be obviated entirely or partly, in particular when the sheets have a relatively high mutual friction in the stack, the technique allowing the abutment force of the outfeed device against the end sheet of the stack of sheets to easily be possible to be kept at a selected value upon the outfeed, in spite of varying sliding resistance of the side of the stack of sheets against a substratum, and furthermore the abutment force of the outfeed device can easily be adjusted to a selected value.

The object is attained by the invention.

The invention is defined in the appended independent claims.

The sheaf of sheets is displaced relatively toward a driver, which contacts the end sheet of the stack of sheets. The sheets in the stack extend substantially in the plane of the feed of the sheaf toward the driver. The driver displaces the end sheet in the plane thereof, away from the sheaf of sheets, usually to a separator, which can separate unintentionally accompanying sheets and allow the same to be taken care of in a controlled way, for instance be collected in a corresponding store. The separator is usually arranged to lead through an individual, thus-separated sheet. However, it is possible to detect the sheets that pass through the separator, and if it then is detected that the passing sheet does not come alone, the passing group of sheets can also be diverted in a manner known per se and be received in a suitable store. The outfeed operation is carried out all the way until it is possible to detect that a certain number of individual sheets have passed from the separator into a transport track, in which the requested number of sheets then can be delivered to a distribution operation of a kind known per se.

A side surface of at least the front end of the sheaf of sheets in the progression direction rests on a substratum, and the driver feeds out the end sheet of the stack of sheets from the stack of sheets in the direction away from the substratum.

The driver is suitably arranged to engage against the end sheet at a substantial distance from the substratum, for instance at a location in the range of 0.5 h-h from the substratum, where h is the sheet height from the substratum.

According to an important feature of the invention, at the beginning of a sheet-outfeed operation, the driver is first brought to drive the sheet in the plane thereof toward the substratum, so that the sheet thereby experiences an elastic deformation from the plane thereof, i.e., a deflection or buckling. This elastic buckling of the end sheet produces an initial separation of the end sheet from the adjacent sheet. Immediately after the buckling operation, the driver is brought to displace the elastically bulged sheet in plane, in the direction away from the substratum/support. The driver is preferably a rotatable roller, the axis of which is parallel to the surface of the end sheet and to the surface of the substratum, so that the end sheet is displaced substantially perpendicular to and away from the substratum.

The roller of the driver is usually rotated at a high speed in order to produce the elastic buckling of the banknote within some milliseconds.

A good function of a driver, for instance, in the form of a rotationally drivable roller, which with the envelope surface contacts the end sheet, usually requires that the driver contacts the end sheet by a predetermined force and has a preset friction coefficient.

In the method according to the invention, this is attained by the fact that, based on the technique defined in the preamble of the independent claims, the measures are carried out and the features of the arrangement are provided, respectively, that are seen in the characteristic part of the respective independent claim. Thus, in the method, the stack is advanced by a pusher toward the drivers, the abutment force between the driver and the foremost sheet of the stack of sheets is detected, and the pusher is brought to push the stack of sheets so that a predetermined force is detected between the driver and the end sheet, the driver being activated for feeding out the front end sheet from the stack. In the arrangement, this is attained by the corresponding features of the arrangement.

According to an embodiment, the advancing force of the stack of sheets against the driver is controlled by the driver being displaceable in the displacement motion of the sheaf of sheets toward and away from a fixed reference surface, the driver being supported from the reference surface via a spring having a known spring characteristic. In that connection, the distance between the driver and the reference surface is detected. A selected normal force between the driver and the end sheet is attained at a determined distance between the driver and the reference surface. By means of a distance sensor, this distance is detected and compared with a set value, the deviation from the set value being brought to control the advancing force of the sheaf of sheets against the driver. In this way, it is possible to compensate for, for instance, the friction of the sheaf of sheets against the substratum.

In case that banknotes fed out are to be advanced to a separator, the sheets/group of sheets have to have a low speed at the entrance of the separator, in order for the separator to work properly. The outfeed speed of the end sheet from the sheaf of sheets should be high, for a plurality of reasons, for instance, in order to allow a quick outfeed of individual sheets from the stack, and, as far as possible, in order to produce a quick speed difference between the end sheet and adjacent sheets of the sheaf. The speed of the end sheet and adjacent sheets possibly conveyed thereby has to be reduced. For the entry of the sheets into the separator, according to a further development of the invention, the group of sheets may, after the reduction in the speed thereof, again be given a quick acceleration by means of the driver before the group of sheets reach up to the separator. This step of operation includes an abrupt speed rise in the direction toward the separator, and a subsequent reduction in speed before the group of sheets reach up to the separator may be repeated a plurality of times. Each such course of events means an enhanced possibility for the driver to give the end sheet a higher speed than the adjacent sheet of the stack, whereby the sheets in a group of sheets that are conveyed by the outfeed device are given a enhanced separation in the transportation direction toward the separator, so that the separator more reliable can separate the sheets that are conveyed by the end sheet.

Thereby, in a preferred embodiment, the proper separator may comprise two rolls or rollers abutting against each other and being independently rotatable. One of the separator rollers rotates in the same rotational direction as the driver roller. Therefore, the mentioned first separator roller and the driver roller may be driven by a common driving motor and be mutually coupled by a fixed transmission. The second separator roller is preferably arranged rotatable in an opposite direction to the first separator roller. A group of sheets fed in toward the entry nip between the separator rollers is, in that connection, oriented so that the end sheet comes closest to the first separator roller and the group of the other sheets accordingly comes closest to the second separator roller, and is thereby diverted by the same on the entry side of the nip. By the fact that the group of sheets has a low speed at the entrance of the separator nip, and furthermore the second separator roller has the indicated rotation, the sheets conveyed by the end sheet are diverted on the entry side of the separator nip and can be diverted in order to be taken care of in a manner known per se.

In order for the separator to have a proper separation function, it is required that the surface of the first roller has a higher friction coefficient than the surface of the second roller, and furthermore, it is naturally required that the abutment pressure between the separator rollers can be maintained within narrow limits in spite of wear.

Known constructions to maintain an adjustable contact force between the rollers in that connection, in spite of wear, commands a high price. In accordance with a further development of the invention, a special displacement arrangement is utilized for this purpose for pressing one of the separator rollers by an easily controllable force, which is substantially independent of the wear of the separator rollers and the diameter change following thereby. According to the invention, this arrangement may be formed of a solenoid comprising a magnet winding and a core displaceable thereby. A person skilled in the art knows that such a solenoid produces a driving force that varies considerably with the applied current from a given driving voltage, along the displacement path. However, by guaranteeing that only a small portion of the possible distance of motion of the solenoid is made use of for the mutual parallel displacement of the separator rollers, the state is attained that upon constant voltage, the force exerted by the solenoid becomes substantially linearly dependent on the applied current. Accordingly, one of the movable separator rollers may be driven against the second separator roller by a force that is easily controllable and insensitive to changes in the active length of the solenoid (the wear of the separator rollers).

In the following, the invention will be described by way of examples, reference being made to the appended drawing.

FIG. 1 schematically shows a side view of an outfeed arrangement and a separator for sheets from a sheaf of sheets.

Figure 2:
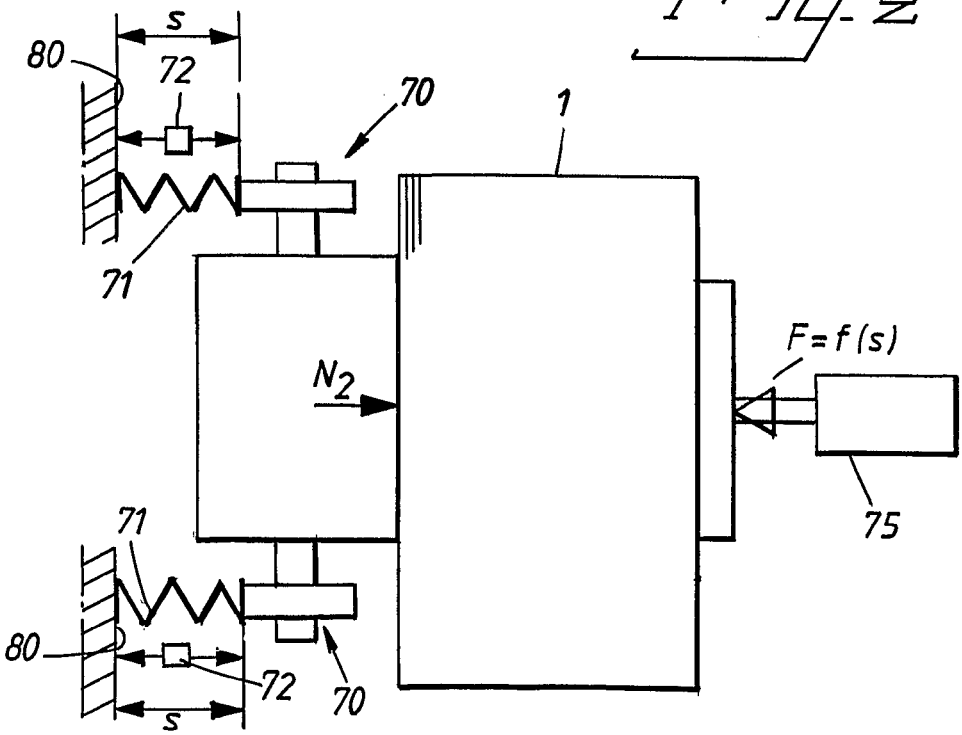

FIG. 2 schematically shows an arrangement in order to control the abutment force of the outfeed arrangement against the sheaf of sheets.

Figure 3:
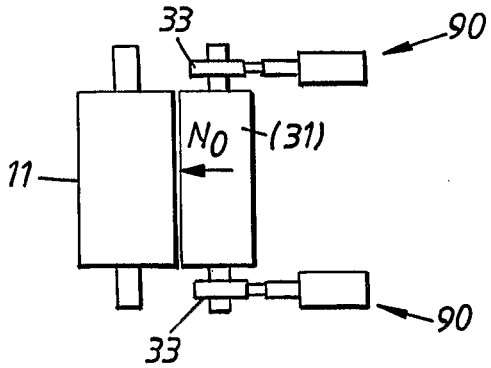

FIG. 3 schematically shows an arrangement for the control of the abutment force between two rollers of the separator.

Figure 4:
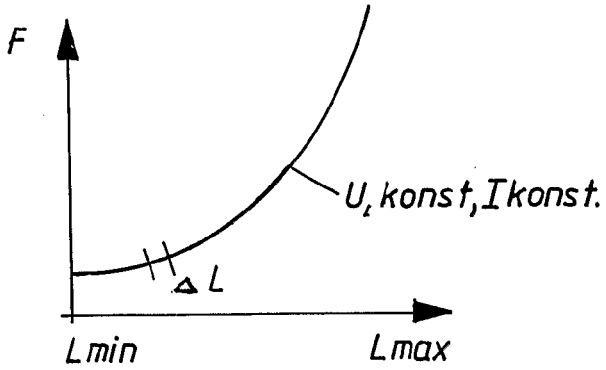

FIG. 4 schematically shows the variation of the force exerted by a solenoid over the entire stroke-length range thereof, at a constant driving voltage and driving current.

Figure 5:
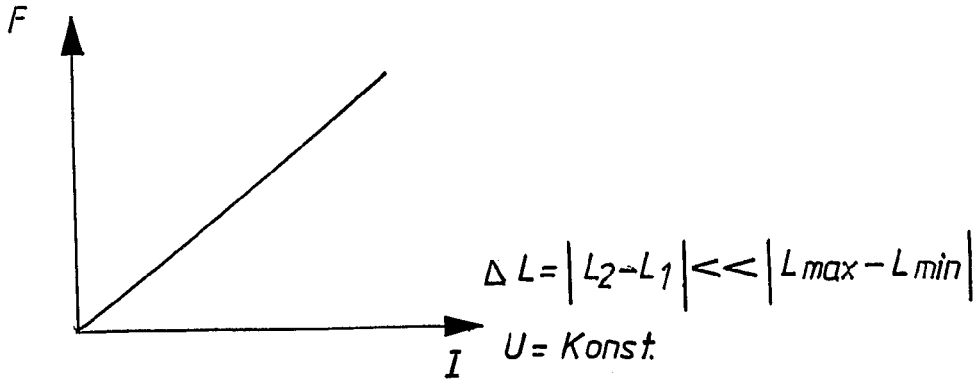

FIG. 5 shows the relation between the force and feed current of the solenoid within a small part range of the stroke length of the solenoid.

In FIG. 1, a substratum 3 is shown, on which a stack of sheets 1 rests. The stack of sheets 1 comprises sheets stacked on each other such as, for instance, banknotes, which normally have an identical format and usually have the extension plane thereof perpendicular to the substratum surface 3, which is parallel to the adjacent side surface of the stack. The stack 1 is displaced in the longitudinal direction 4 thereof so that the end sheet 2' thereof is pressed against an outfeed roller 12, which is parallel to the substratum and to the sheets 2, and contacts the stack 1 at a height above the substratum 3 that preferably is in the upper half thereof, i.e., at a distance in the range of 0.4-0.9 h above the substratum 3.

The stack 1 is pressed against the roller 12 by a force $N_2$, which in combination with the friction coefficient of the circumference surface of the roller 12 produces a selected displacement force of the end sheet 2 upon the rotation of the roller 12.

The stack of sheets 1 may be displaced in relation to the roller 2 together with the substratum 3. Alternatively, the stack 1 may be displaced along the substratum 3. The substratum 3 is provided at least in the area below the end sheet 2'. In FIG. 1, furthermore a separator 48 is seen, which is arranged to receive and lead through the end sheet 2' when the same is fed upward in the plane thereof. If the end sheet 2' is accompanied by one or more adjacent sheets 2 from the stack, the separator serves to separate and divert the accompanying sheets and divert them by a diversion arrangement 49 (not shown in detail), so that only a single sheet, the end sheet 2', passes the separating arrangement and is further led to a conveyor 60. A sensor 61 may be arranged beyond the separator 48 and detect passed banknotes, for instance in order to detect a banknote 2 possibly accompanying the end banknote 2', so that in such a case the passing group of banknotes 2, 2' can be diverted by a diversion arrangement 61 in a known way per se.

The separator 48 is shown to comprise two cylindrical rollers 11, 31 being mutually parallel and pressed against each other. A motor 30 is shown to rotationally drive the separator roller 11 via a belt transmission 21, and the outfeed roller 12 via another transmission 22. The second separator roller 31 is rotationally driven from a motor 31 via a transmission 41, and the roller 31 is rotatable independently of the rotation of the roller 11.

When feeding out the end sheet 2' from the stack 1, the roller 12 is first rotated in a first rotational direction 12A so that the end sheet 2' is driven toward the substratum 3 and in that connection experiences an elastic bulged shape between the sub-stratum 3 and the contact point between the roller 12 and the stack 1. In that connection, the conveying distance of the sheet 2' is small in order to guarantee that the bulging of the sheet 2' is elastic and that the bulged sheet 2' still is in engagement with the roller 12. Next, the rotation of the roller 12 is reversed so that the roller rotates in the rotational direction 12B, whereby the end sheet 2' is displaced upward, away from the substratum 3 toward an entrance nip between the separator rollers 11, 31. If the end sheet 2' is accompanied by one or more adjacent sheets in the movement thereof toward the separator, said accompanying sheets 2 can be separated from the end sheet 2', provided that the group of sheets enters the separator 48 at a low speed. By rotating the roller 31 in a direction such that the circumference surface thereof runs reverse the circumference surface of the roller 11, a separation effect is attained for the accompanying sheets/banknotes 2. The envelope surface of the roller 11 has a friction coefficient $\mu_1$ that is higher than the friction coefficient $\mu_2$ of the roller 31, and the opposite rotational directions of the rollers 11 and 31 entail that the circumference surface of the roller 31 can affect the upper edges of the accompanying sheets 2 along a relatively long distance, so that an efficient separation process is attained compared with the roller 31 standing idle. The periphery speed of the roller 31 is usually lower than the periphery speed of the roller 11. An outfeed operation of a banknote 2' is carried out within a period of time of a few milliseconds.

An efficient separation of sheets in a group of sheets that enters the separator 48 implies that the sheets enter the separator at a low speed, but the roller 12 has to feed out the sheet 2' at a high speed from the stack 1 in order for a sheet-outfeed operation to be executable within a necessarily short period of time. Since the driving motor 10 of the roller 10 is arranged to quickly accelerate the roller 12 and then brake the roller 12, this function may in an advantageous manner be utilized by the fact that the acceleration and the retardation of the roller 12, and thereby of the sheet 2' and possible accompanying sheets 2', are repeated one or more times during the transportation of the sheet 2' toward the separator 48. During each such subsequent acceleration of the end sheet 2', the possibility of a separation of the end sheet 2' from the nearby sheet 2 is improved.

The driving of the end sheet 2' by the roller 12 in a controlled manner implies, among other things, that the abutment force of the roller 12 against the end sheet 2' is maintained within narrow limits.

For that sake, it is suggested that the roller 12' is arranged displaceable in the direction of motion 4 of the stack 1. A mounting 70 for the shaft shank of the roller 12 is carried from a support 80 via a spring 71 having a known spring characteristic. A sensor 72 detects the distance between the support 80 and the mounting 70. This distance s represents the support force against one end of the shaft shank. With the corresponding arrangements at both shaft ends, the normal force $N_2$ of the roller 12' against the end sheet 2' can be maintained by means of a pusher 75, which applies a force for which the sensors 72 detect a preselected distance s, the pusher/roller 12' being activated for feeding out the end sheet from the stack.

In the embodiment illustrated, the spring characteristic is suitably such that the spring force increases with decreasing distance between the spring ends. The end position of the front end sheet of the stack will vary according to the preselected size of the pressing force, but the sheet or sheets fed out is yet inserted reliably into the separator since the envelope surfaces of the stationary separator rollers converge toward the roller nip within a relatively great distance in a direction parallel to the progression direction of the stack of sheets.

The shown embodiment may naturally be varied in many different ways with preserved function. For instance, the two bearings may be supported by a single spring, and furthermore the springs may be arranged as tension springs rather than the shown compression springs.

Since the rollers 11, 31 in the separator 48 will slide against each other or against sheets 2 situated between the same, they are subjected to wear, which means that the rollers 11, 31 have to be movable toward each other and be pressed by an external force transducer in order to have a predetermined mutual abutment force $N_0$ (FIG. 3).

In accordance with a further development of the invention, for that sake it is suggested that one of the separator rollers is arranged displaceable in parallel toward the other roller 11 in a common axis plane, the shaft journals of the roller 31 being received in corresponding displaceable mountings 33, which are displaced by a respective linear solenoid 90.

FIG. 4 illustrates that such commercially available solenoids 90 have a linear stroke length between a minimum value $L_{min}$ and a maximum value $L_{max}$. When a constant voltage U and a constant current I is applied to such a solenoid, the solenoid develops a varying force over the stroke-length range thereof. This makes that a plain solenoid has been considered less suitable for force control.

We have found that for such a solenoid, a small stroke-length range $\delta_1$ may be selected, in which the force can be considered linear. In that connection, FIG. 5 illustrates that, at a constant driving voltage U, it is easy to control the generation of force of the solenoid 90 by a feed current I being proportional thereto. In this way, there are good prospects to maintain a total abutment pressure between the separator rollers and also to compensate for wear of the rollers 11, 31.

A particular advantage of using rollers 11, 31 that are pressed against each other is that, in the situation that a group of sheets 2', 2 cannot be separated by the separator but remains on the entrance nip of the separator, this condition can be detected by, for instance, the sensor 49, which then provides for the withdrawal of the solenoids 90, so that the sheaf can pass through the separator, the sensor 61 situated downstream of the separator detecting that a plurality of sheets simultaneously pass the separator and, in that connection, instructing the diversion arrangement 62 to divert said group of sheets. The alternative would otherwise be that the assembly would need to be stopped, waiting for an operator to obviate the problem (to remove the sheaf abutting against the entry side of the separator 48).

The use of the solenoids 90 implies naturally that the wear of the rollers 11, 31 is relatively small, i.e., that the axial distance between the rollers 11, 31 is a short length much smaller than the maximal stroke length of the solenoids.

From the structure according to FIG. 1, it can be understood that the roller 12 may be directly driven from the motor 10 via the transmissions 21, 22 and that the roller 11 also may be directly driven by the motor 10, i.e., that no freewheels or the like are required. The same thing applies to the roller 31 and the direct driving thereof from the motor 30 via the trans-mission 41.

By rotating the roller 31 in an opposite direction to the roller 11, a prolonged sliding motion is attained between the envelope surface of the roller 31 and the end edges of the sheets in the group of sheets brought to the roller nip of the separator by the feed roller 12.

The invention claimed is:

1. Method for feeding out a sheet from an end of a stack of sheets, wherein subjecting the stack of sheets to a displacement motion substantially perpendicular to the extension planes of the sheets toward a driver, which contacts the end sheet of the stack at a distance from a support in the vicinity of a side surface of the front end part of the stack, in relation to the driver, displacing the end sheet, using the driver, in a direction away from the support and toward a separator, conveying the end sheet in the extension plane thereof, before displacing the end sheet away from the support, using the driver to convey the end sheet toward the support, whereby the end sheet experiences an elastic bulging, advancing the stack of sheets toward the driver by means of a pusher, which acts against the rear end of the stack of sheets, so that the abutment force between the driver and the front end sheet of the stack of sheets is detected, and the stack of sheets are pushed so that a predetermined force is attained between the pusher and the end sheet, and so that, the driver is activated for feeding out the front end sheet from the stack, and subjecting the end sheet, during the displacement toward the separator, to at least two consecutive driving cycles by the driver, each of which cycles comprises that an acceleration is imparted to the end sheet, and after that a deceleration occurring before the end sheet reaches the separator.

2. Method according to claim 1, wherein, when the end sheet is fed out toward the separator, the speed of the end sheet is considerably reduced in relation to an outfeed speed from the stack of sheets, before the end sheet is inserted into the separator.

3. Method according to claim 1, wherein the driver is a rotatable roller that is kept in contact with the stack, that the driver is supported in the displacement direction of the stack of sheets by a spring that offers an increasing support force upon the advancement of the stack by the pusher, and wherein a distance sensor is brought to detect the displacement position of the driver and, at a preselected displacement position of the driver corresponding to a preselected abutment force of the driver against the end sheet, to initiate an outfeed of the end sheet from the stack.

4. Method according to claim 1, wherein between consecutive outfeeds of the foremost end sheets of the stack, the abutment pressure between the driver and the end sheet is reduced.

5. Method according to claim 4, wherein the abutment pressure between the driver and the end sheet is reduced by unloading the pusher.

6. Arrangement for feeding out the end sheet (2') from a stack of sheets, comprising a pusher for relative displacement of the stack of sheets toward a driver that contacts the adjacent ends of the stack, driving means for driving the driver for the displacement of the end sheet in the extension plane thereof in the direction away from a support adjacent to the stack, the driving means being arranged to first bring the driver to drive the end sheet toward the support, for elastic bulging of the end sheet between the support and the impact point of the driver against the end sheet, and that the driving means are arranged to subsequently produce said motion of the end sheet away from the support, and a force sensor arranged to detect an abutment force between the driver and the adjacent sheet, and that, upon a requested outfeed of the end sheet from the stack, the force sensor is arranged to direct the pusher to advance the stack of sheets until the force sensor detects the predetermined abutment force, and that the sensor after that is arranged to activate the driver for a sheet-outfeed operation, wherein the driving means is arranged to, before the arrival of the fed-out sheet to a separating arrangement, reduce the speed of a group of sheets fed out from the stack of sheets and comprising at least the end sheet of the stack, and the driving means is arranged to vary the speed of the driver in the transportation direction toward the separator during the out-feed of the end sheet or the group of sheets, the end sheet first being accelerated and then being given a reduced speed.

7. Arrangement according to claim 6, wherein the driver is a rotatably mounted outfeed roller contacting the end sheet of the stack of sheets, the force sensor comprising a spring that supports the driver, the spring offering an increasing support force upon the advancement of the stack by the pusher, and a distance sensor that detects the displacement position of the driver and keeps the pusher drivingly activated until the driver reaches a preselected displacement position, which corresponds to a preselected abutment force, exerted by the spring, for the driver against the end sheet, and then activates the driver for a sheet-outfeed operation.

8. Arrangement according to claim 6, wherein the pusher is arranged to be unloaded between consecutive outfeeds of the foremost end sheets of the stack.

9. Arrangement according to claim 6, wherein the separating arrangement comprises a pair of parallel rotation rollers abutting against each other, one of which, the first roller, which upon the receipt of a group of sheets will abut against the end sheet of the stack, is rotationally driven for further transportation of the end sheet entering the roller nip of the separating arrangement, and wherein the second roller of the separating arrangement is independently rotationally driven and, during a separation operation, arranged to rotate in a direction to affect the sheets m a direction opposite to the outfeed direction.

10. Method for feeding out a sheet from an end of a stack of sheets, comprising subjecting the stack of sheets to a displacement motion substantially perpendicular to the extension planes of the sheets toward a driver, which contacts the end sheet of the stack at a distance from a support in the vicinity of a side surface of the front end part of the stack, in relation to the driver, displacing the end sheet, using the driver, in a direction away from the support, conveying the end sheet in the extension plane thereof, before displacing the end sheet away from the support, using the driver to convey the end sheet toward the support, whereby the end sheet experiences an elastic bulging, advancing the stack of sheets toward the driver by means of a pusher, which acts against the rear end of the stack of sheets, so that the abutment force between the driver and the front end sheet of the stack of sheets is detected, and the stack of sheets are pushed so that a predetermined force is attained between the pusher and the end sheet, and so that the driver is activated for feeding out the front end sheet from the stack, and reducing the abutment pressure between the driver and the end sheet between consecutive outfeeds of the foremost end sheets of the stack.

11. Method according to claim 10, wherein the abutment pressure between the driver and the end sheet is reduced by unloading the pusher.

12. Method according to claim 10, further comprising feeding out the end sheet toward a separator, such that the speed of the end sheet is considerably reduced in relation to the outfeed speed from the stack of sheets before the end sheet is inserted into the separator.

13. Method according to claim 10, further comprising subjecting the end sheet, while displacing the end sheet toward a separator, to at least two consecutive driving cycles by the driver, each of which cycles comprises that an acceleration is imparted to the end sheet, and after that a deceleration occurring before the end sheet reaches the separator.

14. Method according to claim 10, wherein the driver is a rotatable roller that is kept in contact with the stack, the driver being supported in the displacement direction of the stack of sheets by a spring that offers an increasing support force upon the advancement of the stack by the pusher, and wherein a distance sensor is brought to detect the displacement position of the driver and, at a preselected displacement position of the driver corresponding to a preselected abutment force of the driver against the end sheet, to initiate an outfeed of the end sheet from the stack.

* * * * *